US007343768B2

(12) United States Patent
Kim

(10) Patent No.: US 7,343,768 B2
(45) Date of Patent: Mar. 18, 2008

(54) METHOD OF NET-FORMING AN ARTICLE AND APPARATUS FOR SAME

(75) Inventor: Young Sik Kim, Canton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/402,554

(22) Filed: Apr. 12, 2006

(65) Prior Publication Data

US 2007/0240480 A1 Oct. 18, 2007

(51) Int. Cl.
*B21J 13/00* (2006.01)

(52) U.S. Cl. ..... 72/355.4; 72/353.2; 72/267; 72/57

(58) Field of Classification Search ..... 72/355.4, 72/267, 271, 273, 371, 711, 57, 353.2, 367; 29/893, 893.34
See application file for complete search history.

(56) References Cited

U.S. PATENT DOCUMENTS 3,874,207 A * 4/1975 Lemelson ..... 72/56
4,831,861 A * 5/1989 Hofmann et al. ..... 72/355.6

FOREIGN PATENT DOCUMENTS

GB 1550630 * 9/1979
JP 59039443 A * 3/1984

OTHER PUBLICATIONS

Mubea Inc. marketing information provided to Young Kim in 2004 regarding high frequency spline pressing.

* cited by examiner

*Primary Examiner*—Derris H. Banks
*Assistant Examiner*—Debra M Wolfe

(57) ABSTRACT

A method of forming an article such as a helical gear and an apparatus for forming the article are provided. The method includes applying pulsating pressure downward to extruding the work piece and, while the pressure is applied downward, injecting fluid to surround the work piece in fluid. The method eliminates pickling processes and phosphate lube coatings typically required for extrusion and external machining steps subsequently required to remove the coating. Extrusion of a cold net-formed article is thus possible due. An apparatus for carrying out the method is also provided.

19 Claims, 2 Drawing Sheets

METHOD OF NET-FORMING AN ARTICLE AND APPARATUS FOR SAME

TECHNICAL FIELD

This invention relates to net-forming an article such as a gear by cold extrusion in a die apparatus.

BACKGROUND OF THE INVENTION

Cold extrusion is used to form gears used in automotive transmissions. Typically, a bonderizing process is required to deposit a phosphate lubrication coating on an exterior surface of the work piece or blank used in forming the gear to allow adequate movement of work piece material within the dies used during extrusion. The bonderizing process creates an oxidation layer which must be machined after extrusion. The machining process creates stress risers, especially in the tooth root area of a helical gear. This limits the ability to use net-formed gears that have been subjected to the bonderizing step in a transmission if the transmission shift schedule will require heavy loading on the gear geometry.

SUMMARY OF THE INVENTION

A die apparatus and a method of forming an article such as a gear are provided that eliminate extra processing steps, such as bonderizing and external machining, to allow a net-formed article, such as a helical or other type of gear, having sufficient strength to maintain integrity during heavy loading. The process improves grain flow of the work piece material and eliminates external machining steps that cause stress risers associated with failed gears.

A method is provided that includes positioning a work piece between upper and lower punches that are operatively connected to upper and lower dies. The method includes applying pulsating pressure downward on the upper punch via the upper die to extrude the work piece, preferably backward extrusion of gear teeth on an outer surface of the work piece. The pulsating pressure may be applied by varying hydraulic pressure applied to the upper die such as through a regulator valve. Alternatively, the pulsating pressure may be applied by powering a high frequency unit operatively connected to the upper die and applying a constant hydraulic pressure to the upper die. The high frequency unit vibrates to cause pulsation of the upper punch.

The method includes injecting fluid between the dies to surround the work piece in the fluid. This may be accomplished by supplying pressurized fluid to a chamber that encompasses the work piece and is partially formed by the dies. The pulsation of the upper punch allows continuous replenishing of fluid within the chamber. The fluid in the chamber lubricates and cools the work piece during extrusion to allow improved grain flow and surface geometry.

The method may also provide an extruded inner surface of the work piece by inserting a core rod through the inner diameter of the work piece prior to the applying pulsating pressure step and then extruding the inner surface of the work piece by moving the core rod upward, to thereby further form the article. Preferably, the extruded inner surface has splines. Extrusion of the inner surface is preferably done after the extrusion of the outer surface. The extruding is considered cold extrusion as it is performed at temperatures less than about 220 degrees Fahrenheit. With the injecting fluid step, the work piece, punches and dies may be sufficiently cooled such that the extrusion is performed at even lower temperatures, approximately 130 to 170 degrees Fahrenheit. The method is characterized by an absence of additional machining operations. Thus, the article is cold net-formed. The fluid applied in combination with the pulsating downward pressure of the upper punch eliminates the need for a phosphate coating with its associate dioxides formed on the surface of the article. Thus, stress risers are eliminated, improving article life.

An apparatus for net-forming a gear includes a die holder and a die at least partially supported by the die holder. The die is movable within the die holder toward the work piece. The die holder at least partially forms a chamber in which the work piece is received. A punch is operatively connected with the die and moves axially toward the chamber in response to hydraulic pressure on the die for extruding the work piece. The die holder at least partially forms a fluid passage in fluid communication with the chamber. The work piece is at least partially submerged in the fluid when the punch extrudes the work piece. A high frequency unit powerable to pulsate pressure of the die upon the punch may be employed. Alternatively, a regulator in fluid communication between a source of pressurized fluid and the upper die may be used and is operable to vary pressure operative upon the die.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
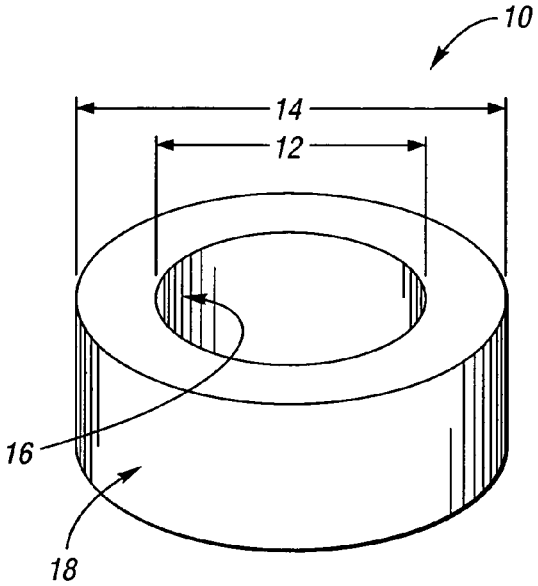
FIG. 1 is a schematic perspective illustration of a work piece.

Referring to the drawings, wherein like reference numbers refer to like components, FIG. 1 shows a work piece 10, also referred to herein as a blank. The work piece 10 is preferably a generally cylindrical, cast aluminum alloy or steel blank having an inner diameter 12 and an outer diameter 14 with respective inner and outer surfaces 16, 18. As described herein, the work piece 10 is placed within the die apparatus 28 of FIG. 3 and subjected to the processing steps included in the method illustrated in the flow chart of FIG. 4 to form the helical gear 10A of FIG. 2. The helical gear 10A is net-formed with extruded helical gear teeth 24 at a newly formed outer surface 18A and extruded splines 26 at a newly formed inner surface 16A.

Figure 2:
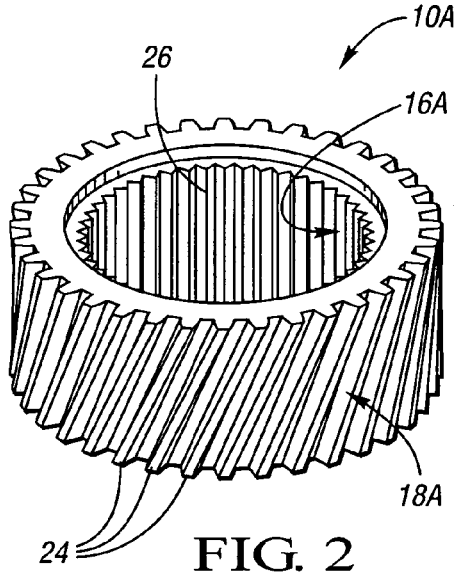
FIG. 2 is a schematic perspective illustration of a net-formed helical gear formed from the work piece of FIG. 1.
Figure 3:
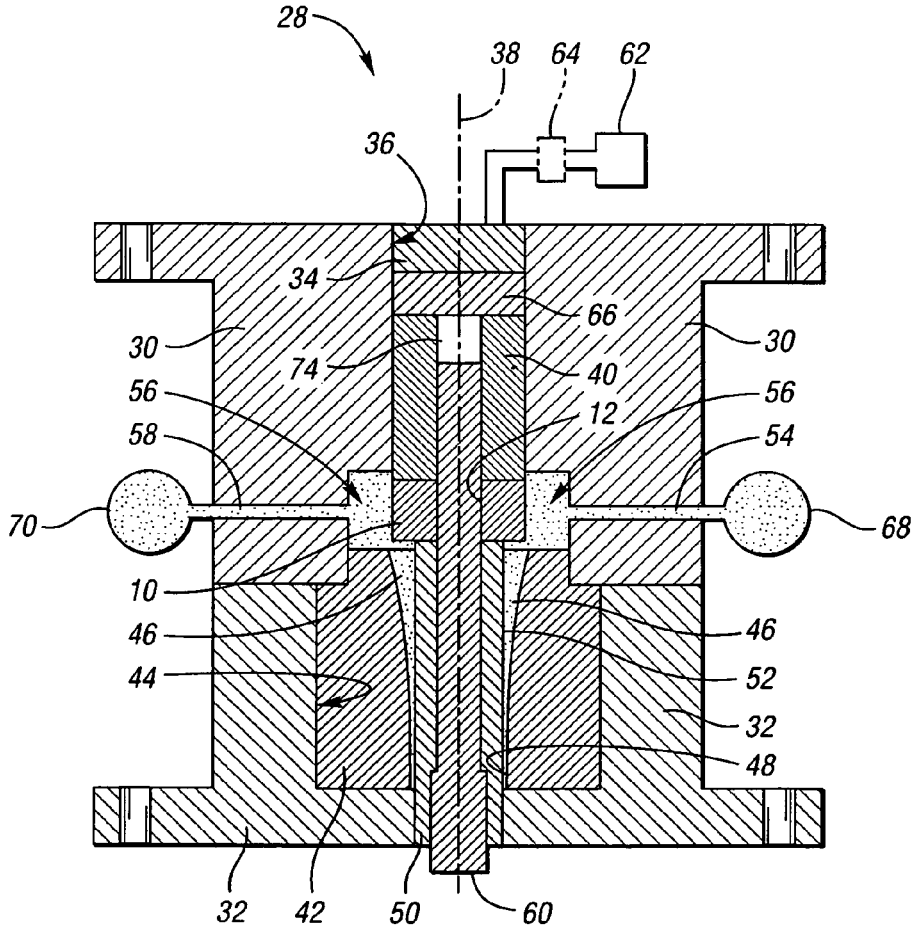
FIG. 3 is a die assembly used to form the helical gear of FIG. 2.

Referring to FIG. 3, the die apparatus 28 includes an upper die holder 30 positioned to align with a lower die holder 32. The upper die holder 30 supports an upper die 34 within a central cavity 36 for movement along a central axis 38. An upper punch 40 is also supported by the upper die holder 30 for movement along central axis 38 in response to hydraulic pressure applied to the upper die 34 as further described below. The lower die holder 32 supports a lower die 42 within an additional central cavity 44 for movement along the central axis 38. The lower die 42 has die cavity formations 46 which are tapered recesses, spaced radially about an inner diameter 48 of the lower die 42. The die cavity formations 46 are designed to cause material of the work piece 10 to form the helical gear teeth 24 shown in FIG. 2. It should be appreciated that within the scope of the invention other die cavity formations may be utilized to form other types of gears, or other articles that are traditionally formed by a cold-forming or a powdered metal compaction process. A lower punch 50 is also partially supported by the lower die holder 32 for movement along central axis 38. The lower punch 50 is sized so that an outer circumference 52 of the lower punch fits within the inner diameter 48 of the lower die 42. The lower punch 50 moves along central axis 38 in response to sufficient hydraulic pressure.

The upper die holder 30 has fluid passages 54 and 58 bored, drilled or otherwise provided therein. The fluid passages 54 and 58 are in fluid communication with a chamber 56 formed between the upper die holder 30 and the lower die 42.

When the die apparatus 28 is opened by moving the upper die holder 30 upward along central axis 38 a sufficient distance, work piece 10 may be positioned such that it is supported on lower punch 50 and is centered at central axis 38. The upper die holder 30, along with upper punch 40 and upper die 34 may then be axially lowered to secure the work piece 10. Once work piece 10 is secured, a core rod 60 is inserted upward through an internal opening of the lower punch 50, through the inner diameter of work piece 10 and through an internal opening of upper punch 40. FIG. 3 shows the work piece 10 thus positioned, secured between the upper and lower punches 40, 50 and having core rod 60 inserted therethrough.

To begin the extrusion process, hydraulic pressure from a pressure source 62 is applied to the upper die 34 to move the upper punch 40 downward. The effective pressure applied on the upper die 34 oscillates in magnitude so that the upper punch 40 pulsates axially as it travels downward. There are two alternative ways to achieve pulsation of the upper punch 40. First, a high frequency unit 66 may be positioned between the upper die 34 and the upper punch 40 and electronically controlled to oscillate therebetween. In that case, a constant hydraulic pressure, such as a pumped fluid, applied by a hydraulic pressure source 62 upon upper die 34 is changed by the high frequency unit 66 into a pulsating pressure acting to move the upper punch 40 downward. Alternatively, in lieu of the high frequency unit 66, a regulator valve 64 may be electronically controlled to vary the pressure applied by the hydraulic pressure source 62 to the upper die 34, thus varying the pressure applied to the upper punch 40 in a pulsating manner. In this case, the upper die 34 would directly contact the upper punch 40 and no high frequency unit 66 would be positioned therebetween.

As the pulsating upper punch 40 is moved downward, the lower punch 50 is simultaneously moved downward, by the force of the upper die 34. Also, lubrication fluid from fluid supply 68 is injected through fluid passage 54 into chamber 56 to bathe the work piece 10 in fluid as it is backward extruded into the die cavity formations 46 of the lower die 42. An additional fluid supply 70 injects fluid through fluid passage 58 to further bathe work piece 10. Preferably, adequate fluid is supplied to surround the work piece 10 and to lubricate the lower die 42. Upward pulsations of the upper punch 40 periodically move the upper punch 40 upward to allow fluid communication between the chamber 56 and the die cavity formations 46 of the lower die 42. This allows additional fluid to continue moving from chamber 56 into contact with the work piece 10 as the work piece 10 is elongated within the die cavity formations 46. Optionally, radial slots may be machined or formed at the lower surface of the upper punch 40, just above the work piece 10, to further aid fluid flow from chamber 56 to bathe the work piece 10. Frequency of pulsation of the upper punch 40 and oil pressure provided in chamber 56 may be selected and controlled to ensure adequate lubrication of the work piece 10 during extrusion. The backward extrusion elongates the material of the work piece, orienting the grain structure and strengthening the work piece 10 by cold working. Fluid is expelled through a drain passage (not shown) formed through lower die 42 and lower die holder 32 or through lower punch 50 to allow continuous replenishing of the chamber 56 with lower temperature fluid from passages 54 and 58.

When the upper and lower punches 40, 50 have been lowered a predetermined amount, the net-formed helical gear teeth 24 on the outer surface 18A are completed, and the work piece 10 is held by the dies 32, 42 near the lower end of the lower die 42. The core rod 60 is then moved upward through cavity 74 and the inner diameter 12 of work piece 10 along the central axis 38. The core rod 60 has an externally splined outer circumference. Thus, upward movement of the core rod 60 extrudes mating internal splines 26 at the inner surface 16A as shown in FIG. 2.

Figure 4:
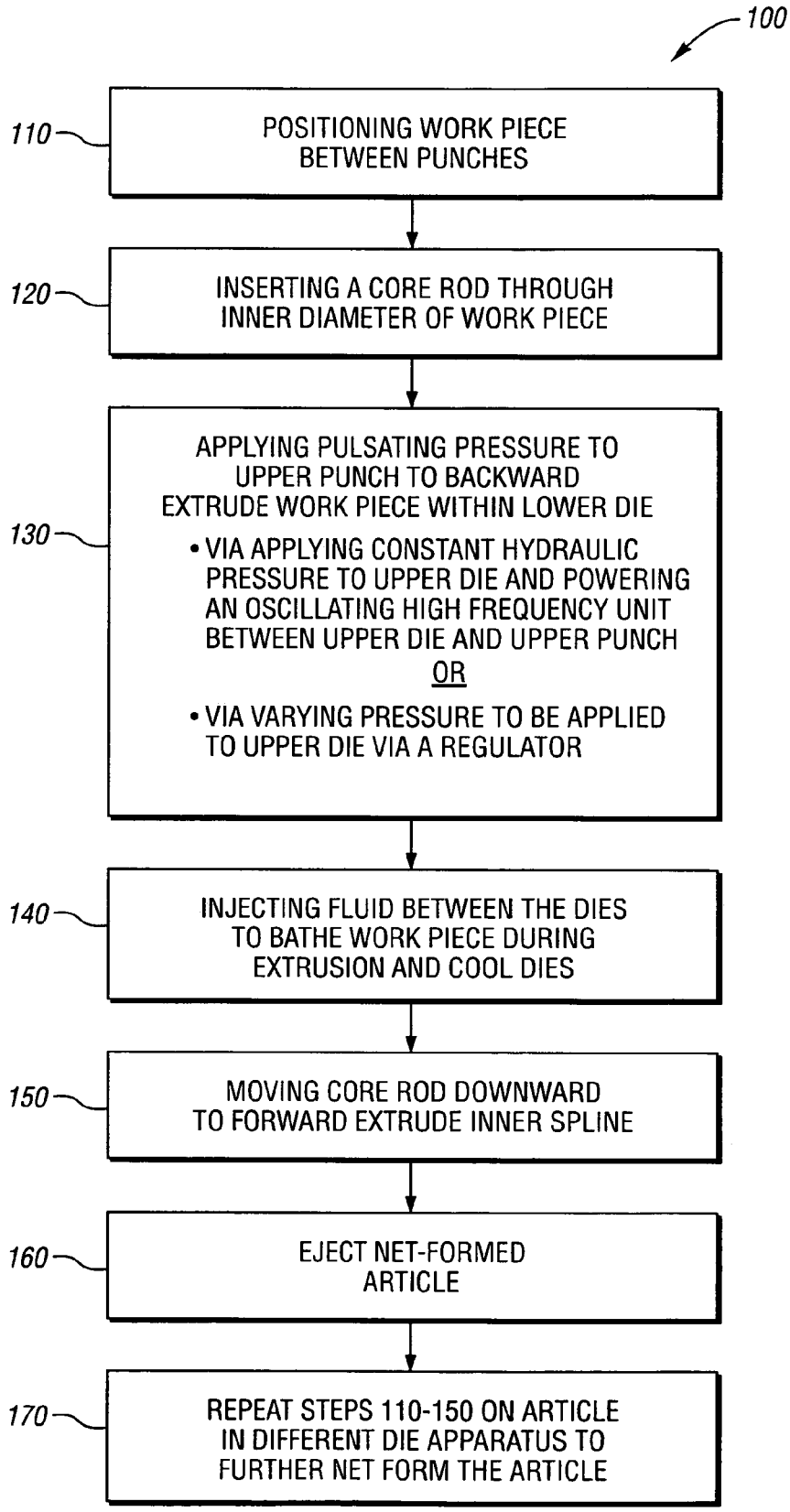
FIG. 4 is a flow chart representing a method of forming the helical gear of FIG. 2.

Referring to FIG. 4, a flow diagram of a method 100 of forming an article such as a helical gear will be discussed with respect to the structure shown in FIGS. 1-3. Unless otherwise indicated herein, the steps of the method 100 need not be performed in the order shown in FIG. 4. The method 100 includes step 110, positioning the work piece 10 between upper and lower punches 40, 50. Specifically, the positioning step 110 includes securing the work piece 10 between the upper punch 40 and the lower punch 50 such that it is supported within the upper die holder 30 and lower die holder 32. Next, the method 100 includes step 120, inserting a core rod 60 through the inner diameter of the work piece 10. Specifically, the inserting step 120 includes moving the core rod 60 upward through the inner diameter 12 of the work piece 10.

The method 100 includes step 130, applying pulsating pressure downward on the upper punch 40 to backward extrude the work piece 10 within the lower die 50. As discussed above, the applying pulsating pressure step 130 may be achieved in various alternative ways. One method involves applying a constant hydraulic pressure to the upper die 34 and powering an oscillating high frequency unit 66 that is positioned between the upper die 34 and the upper punch 40 to transfer a pulsating pressure to the work piece 10 via the upper punch 40. Alternatively, the applying pulsating pressure step 130 may be achieved by varying hydraulic pressure applied to the upper die 34. This is accomplished by positioning a regulator 64 such as a regulator valve, as is known to those skilled in the art, that transmits reciprocating pressure levels to act upon the upper die 34 when the regulator valve 64 is in fluid communication with a constant pressure source 62.

The method 100 also includes step 140, injecting fluid between the upper and lower dies 34, 42 to bathe the work piece 10 during extrusion to lubricate and cool both the work piece 10 and the bottom die 42. The injecting fluid step 140 is accomplished via the fluid passage 54 and 58 with the fluid accumulating in chamber 56 to surround the work piece 10. The applying pulsating pressure step 130 allows the upper punch 40 to lift in an oscillating manner, thus allowing additional fluid to access the work piece 10 as it is extruded in the bottom die 42. The injecting fluid step 140 allows for improved material flow of the work piece 10, eliminating turbulence at the tooth root area, i.e., at the inner diameter of the outer surface 18A between formed helical teeth 24 of FIG. 2. The turbulence acts as a stress riser and typically must be machined away in conventional gear production. Even then, the tooth root area still contains the possibility of stress risers thus increasing the possibility of gear failure. Step 140 thus allows for net-forming of the gear 18A with an elimination of additional machining operations. Step 140, injecting fluid, also prevents heat buildup within the die apparatus 28, thus reducing the possibility of die cracking and improving die life. Additionally, the fluid provided at the surface of the work piece 10 eliminates a traditional bonderizing surface finish process typically performed prior to extrusion. Bonderizing involves pickling the outer surface of a work piece to deposit a phosphate coating. The constant fluid contact with the work piece 10 during of method 100 made possible by step 130, applying pulsating pressure, and step 140, injecting fluid, eliminates the need for a coating and makes possible elimination of the bonderizing process. Because no additional machining processes are required after extrusion, the applying pulsating pressure step 130 and injecting fluid step 140 allows the gear 10A to be net-formed.

The method 100 includes step 150, moving the core rod 60 upward to extrude the internal spline teeth 26. During step 150, the pulsating pressure may continue to be applied through the upper die 34 and the injected fluid will continue to bathe the internal surface 16 of the work piece 10 during the extrusion of the internal splines 26.

In step 160, the net-formed article (e.g., helical gear 10A) is ejected from the dies 34, 42. Depending on the complexity of the final article, further extrusion may be required in one or more die apparatuses. If necessary to enable proper flow of material in the article, it may be annealed and lubricated before it is positioned in the additional die apparatus. The additional die apparatus(es) may be arranged in-line or in a die rotating transfer press. Steps 110, 120, 130, 140, 150, and optionally 150, may then be performed on the article in the additional die apparatus(es) to further cold net-form the article until a final desired formation of the article is achieved. The additional die apparatus(es) would be similar to dies apparatus 28 of FIG. 2, except that the lower die 42 would have slightly differently shaped die cavity formations and the core rod would be have slightly differently shaped splines.

The die apparatus 28 of FIG. 3 and the method 100 of FIG. 4 provide an improved net-formed, cold extrusion process for forming an article such as helical gear 10A of FIG. 2, by improving metal flow and surface microfinish, with a minimal number of process steps.

While the best modes for carrying out the invention have been described in detail, those familiar with the art to which this invention relates will recognize various alternative designs and embodiments for practicing the invention within the scope of the appended claims.

The invention claimed is:

1. A method comprising:

positioning a work piece between upper and lower punches operatively connected to upper and lower dies;

applying pulsating pressure downward on the upper punch via the upper die, thereby extruding the work piece;

during said applying, injecting fluid between the dies to surround the work piece in fluid;

inserting a core rod through an inner diameter of the work piece prior to said applying pulsating pressure downward; and extruding an inner surface of the work piece by moving the core rod upward, thereby forming an article from the work piece.

2. The method of claim 1, wherein said applying pulsating pressure downward causes backward extrusion of an outer surface of the work piece.

3. The method of claim 1, wherein the article is a gear; wherein applying pulsating pressure downward to extrude the work piece includes extruding gear teeth on an outer surface of the work piece; and wherein extruding an inner surface of the work piece includes extruding splines.

4. The method of claim 1, wherein said extruding is cold extruding.

5. The method of claim 1, wherein said applying pulsating pressure is by varying hydraulic pressure applied to the upper die.

6. The method of claim 1, wherein said applying pulsating pressure includes powering a high frequency unit operatively connected to the upper die and applying a constant hydraulic pressure to the upper die.

7. The method of claim 1, wherein the dies are supported by die holders, and wherein said injecting fluid between the dies includes supplying pressurized fluid to a chamber that encompasses the work piece and is partially formed by the die holders.

8. The method of claim 7, wherein said applying pulsating pressure causes replenishing of fluid in the chamber.

9. The method of claim 1, wherein the method is characterized by an absence of additional machining operations such that said article is net-formed.

10. The method of claim 1, wherein the extruded article is a helical gear.

11. The method of claim 1, wherein the method is characterized by an absence of depositing a phosphate lube coating on the work piece.

12. The method of claim 1, wherein the upper and lower punches and said upper die are on a first die apparatus, and further comprising:

ejecting the article from the first die apparatus; and repeating said positioning, said applying pulsating pressure and said injecting fluid on the article in a separate die apparatus to further form the article.

13. An apparatus for net-forming a gear from a work piece having an inner diameter and an outer diameter, the apparatus comprising:

a die holder that at least partially forms a chamber in which the work piece is receivable;

an upper die at least partially supported by said die holder and movable within said die holder toward the work piece;

a lower die having cavity formations;

an upper punch axially movable toward said chamber in response to hydraulic pressure on said die for extruding the work piece within the lower die such that the cavity formations contact the outer diameter to create external gear teeth on the work piece;

wherein said die holder at least partially forms a fluid passage in fluid communication with said chamber such that the work piece is at least partially submerged in fluid when said upper punch extrudes the work piece;

a core rod extending through the inner diameter and axially movable in an opposite direction as the upper punch; and wherein the core rod is configured to contact the inner diameter to create internal splines on the work piece.

14. The apparatus of claim 13, further comprising:

a high frequency unit powerable to pulsate pressure of the upper die upon the punch.

15. The apparatus of claim 13, further comprising:

a regulator in fluid communication between a source of pressurized fluid and the die and operable to vary pressure operative upon the upper die.

16. A method of net-forming a gear comprising:

applying pulsating pressure in a first direction on a work piece to extrude external gear teeth on the work piece; and further extruding the work piece by moving a punch in a second opposing direction to form internal splines on the work piece; said applying pulsating pressure and further extruding thereby forming the gear.

17. The method of claim 16, further comprising:

surrounding the work piece in fluid during said applying pulsating pressure and said further extruding the work piece.

18. The method of claim 17, wherein said extruding is cold extruding.

19. The method of claim 17, wherein said method is characterized by an absence of depositing a phosphate lube coating on said work piece.

* * * * *